US011409311B2

(12) United States Patent
Tai

(10) Patent No.: US 11,409,311 B2
(45) Date of Patent: Aug. 9, 2022

(54) VOLTAGE REGULATOR HAS A CHARACTERISTIC OF FAST ACTIVATION

(71) Applicant: RichWave Technology Corp., Taipei (TW)

(72) Inventor: Shun-Nan Tai, Taipei (TW)

(73) Assignee: RichWave Technology Corp., Taipei (TW)

( * ) Notice: Subject to any disclaimer, the term of this patent is extended or adjusted under 35 U.S.C. 154(b) by 0 days.

(21) Appl. No.: 17/138,913

(22) Filed: Dec. 31, 2020

(65) Prior Publication Data

US 2022/0171416 A1 Jun. 2, 2022

(30) Foreign Application Priority Data

Nov. 30, 2020 (TW) ..... 109142065

(51) Int. Cl.

| | |
|---|---|
| ***G05F 1/46*** | (2006.01) |
| *G05F 1/565* | (2006.01) |
| *G05F 1/575* | (2006.01) |

(52) U.S. Cl.

CPC ..... *G05F 1/468* (2013.01); *G05F 1/565* (2013.01); *G05F 1/575* (2013.01)

(58) Field of Classification Search

CPC ..... G05F 1/468; G05F 1/565; G05F 1/575
See application file for complete search history.

(56) References Cited

U.S. PATENT DOCUMENTS

| | | | | |
|---|---|---|---|---|
| 6,445,167 | B1 | 9/2002 | Marty | |
| 2013/0113454 | A1* | 5/2013 | Chen | G05F 1/56 323/312 |

(Continued)

FOREIGN PATENT DOCUMENTS

| | | |
|---|---|---|
| TW | 201439704 | 10/2014 |
| TW | 202014827 | 4/2020 |

(Continued)

OTHER PUBLICATIONS

"Office Action of Taiwan Counterpart Application", dated Jun. 21, 2021, p. 1-p. 5.

(Continued)

*Primary Examiner* — Adolf D Berhane
*Assistant Examiner* — Lakaisha Jackson
(74) *Attorney, Agent, or Firm* — JCIPRNET

(57) ABSTRACT

A voltage regulator is provided. The voltage regulator includes an output terminal, a transistor, a primary driving circuit, and a secondary driving circuit. The output terminal is adapted to output an output voltage. The primary driving circuit is coupled to a control terminal of the transistor. The secondary driving circuit is coupled between the control terminal of the transistor and a predetermined voltage terminal. When the voltage regulator operates in a start-up mode, the transistor is driven by the primary driving circuit and the secondary driving circuit, and the control terminal of the transistor and the predetermined voltage terminal are electrically coupled by the secondary driving circuit. When the voltage regulator operates in a normal mode, the transistor is driven by the primary driving circuit, and an electrical coupling between the control terminal of the transistor and the predetermined voltage terminal is disconnected by the secondary driving circuit.

20 Claims, 8 Drawing Sheets

(56) References Cited

U.S. PATENT DOCUMENTS

| | | | | |
|---|---|---|---|---|
| 2014/0029141 | A1 | 1/2014 | Yahagi et al. | |
| 2015/0137781 | A1 | 5/2015 | Qu et al. | |
| 2015/0188423 | A1 | 7/2015 | Tomioka et al. | |
| 2018/0006550 | A1 * | 1/2018 | Kao ..... | H02H 3/087 |

FOREIGN PATENT DOCUMENTS

| | | |
|---|---|---|
| TW | 202014828 | 4/2020 |
| TW | 202025610 | 7/2020 |
| TW | 202030959 | 8/2020 |
| WO | 2015017236 | 2/2015 |
| WO | 2015135254 | 9/2015 |

OTHER PUBLICATIONS

"Search Report of Europe Counterpart Application", dated May 2, 2022, p. 1-p. 8.

* cited by examiner

VOLTAGE REGULATOR HAS A CHARACTERISTIC OF FAST ACTIVATION

CROSS-REFERENCE TO RELATED APPLICATION

This application claims the priority benefit of Taiwan application serial no. 109142065, filed on Nov. 30, 2020. The entirety of the above-mentioned patent application is hereby incorporated by reference herein and made a part of this specification.

BACKGROUND

Technical Field

The disclosure relates to a voltage regulator, and more particularly to a voltage regulator capable of quickly increasing the voltage value of an output voltage in a start-up mode.

Description of Related Art

The current design trend of voltage regulators has evolved from high power to low power and into increasing output currents. However, the type of voltage regulator usually has internal elements operating at a slower response speed, resulting in longer time for the voltage regulator to adjust the output voltage to the required voltage value.

SUMMARY

The disclosure provides a voltage regulator capable of achieving low power, fast activation, and reducing risks of transistor damage.

The voltage regulator in the disclosure includes an output terminal, a first transistor, a primary driving circuit, and a secondary driving circuit. The output terminal is adapted to output an output voltage. The first transistor includes a first terminal, a second terminal, and a control terminal. The first terminal of the first transistor is coupled to a first voltage terminal and is adapted to receive a first voltage, and the second terminal of the first transistor is coupled to the output terminal of the voltage regulator. The primary driving circuit includes a first input terminal, a second input terminal, and an output terminal. The first input terminal of the primary driving circuit is coupled to the output terminal of the voltage regulator and is adapted to receive the output voltage. The second input terminal of the primary driving circuit is adapted to receive a reference voltage, and the output terminal of the primary driving circuit is coupled to the control terminal of the first transistor. The secondary driving circuit includes a first terminal and a second terminal. The first terminal of the secondary driving circuit is coupled to the control terminal of the first transistor, and the second terminal of the secondary driving circuit is coupled to a predetermined voltage terminal. When the voltage regulator operates in a start-up mode, the first transistor is driven by the primary driving circuit and the secondary driving circuit, and the control terminal of the first transistor and the predetermined voltage terminal are electrically coupled by the secondary driving circuit. When the voltage regulator operates in a normal mode, the first transistor is driven by the primary driving circuit, and an electrical coupling between the control terminal of the first transistor and the predetermined voltage terminal is disconnected by the secondary driving circuit.

DESCRIPTION OF THE EMBODIMENTS

Figure 1:
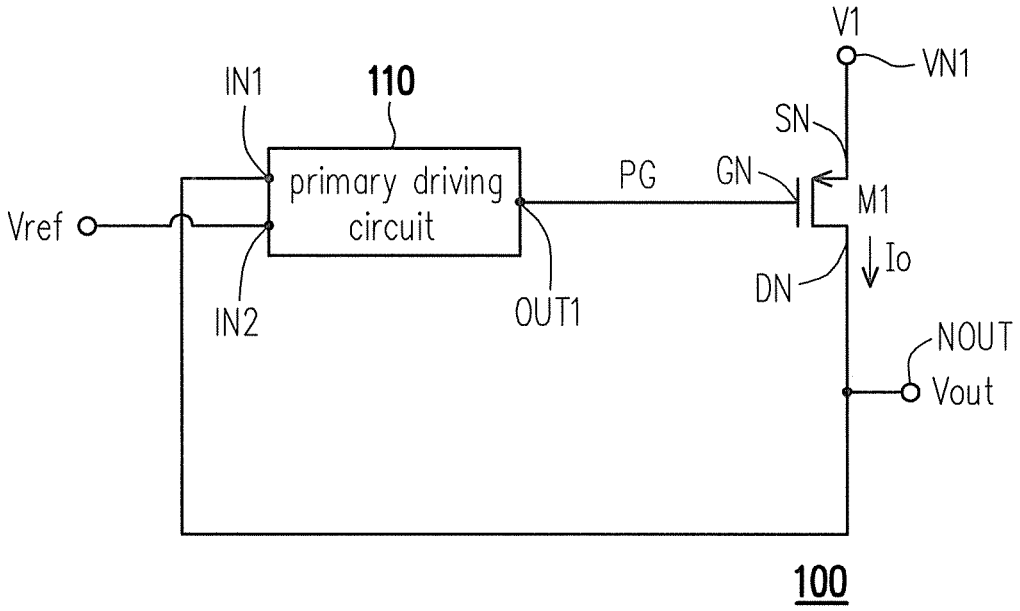
FIG. 1 (PRIOR ART)
FIG. 1 is a block view of a voltage regulator.

FIG. 1 is a block view of a voltage regulator 100. The voltage regulator 100 includes a low-dropout regulator (LDO) for adjusting an output voltage Vout to a required voltage value. Referring to FIG. 1, the voltage regulator 100 includes an output terminal NOUT, a transistor M1, and a primary driving circuit 110. The output terminal NOUT is adapted to output the output voltage Vout. In some embodiments, the output terminal NOUT of the voltage regulator 100 may be adapted to be coupled to a load, and may provide a stable output voltage Vout to the load. Moreover, with a proper design of the primary driving circuit 110 in the disclosure, the primary driving circuit 110 is capable of operating normally under an extremely low current. In this way, the voltage regulator 100 has a characteristic of low power.

The transistor M1 may include a P-type metal oxide semiconductor (PMOS) transistor, a P-type field effect transistor (PFET), or a PNP-type bipolar transistor (BJT). In the embodiment, the transistor M1 including a PMOS transistor is illustrated as an example. The transistor M1 includes a first terminal SN, a second terminal DN, and a control terminal GN. The first terminal SN of the transistor M1 is, for example, a source terminal; the second terminal DN is, for example, a drain terminal; and the control terminal GN is, for example, a gate terminal. The first terminal SN of the transistor M1 is coupled to a voltage terminal VN1 and is adapted to receive a voltage V1. The voltage V1 may be a supply voltage or a system voltage. The second terminal DN of the transistor M1 is coupled to the output terminal NOUT of the voltage regulator 100. In some embodiments, the transistor M1 may also be implemented as an N-type metal oxide semiconductor (NMOS) transistor, an N-type field effect transistor (NFET), or an NPN-type BJT.

The primary driving circuit 110 includes an input terminal IN1, an input terminal IN2, and an output terminal OUT1. The input terminal IN1 of the primary driving circuit 110 is coupled to the output terminal NOUT of the voltage regulator 100 and is adapted to receive the output voltage Vout. The input terminal IN2 of the primary driving circuit 110 is adapted to receive a reference voltage Vref. In some embodiments, the reference voltage Vref may be a bandgap reference voltage. The output terminal OUT1 of the primary driving circuit 110 is coupled to the control terminal GN of the transistor M1. The primary driving circuit 110 is adapted to compare the output voltage Vout and the reference voltage Vref to generate an operating signal PG at the output terminal OUT1. The operating signal PG is adapted to adjust an output current Io flowing through the transistor M1, and thereby the output voltage Vout is adjusted by the operating signal PG.

Figure 2:
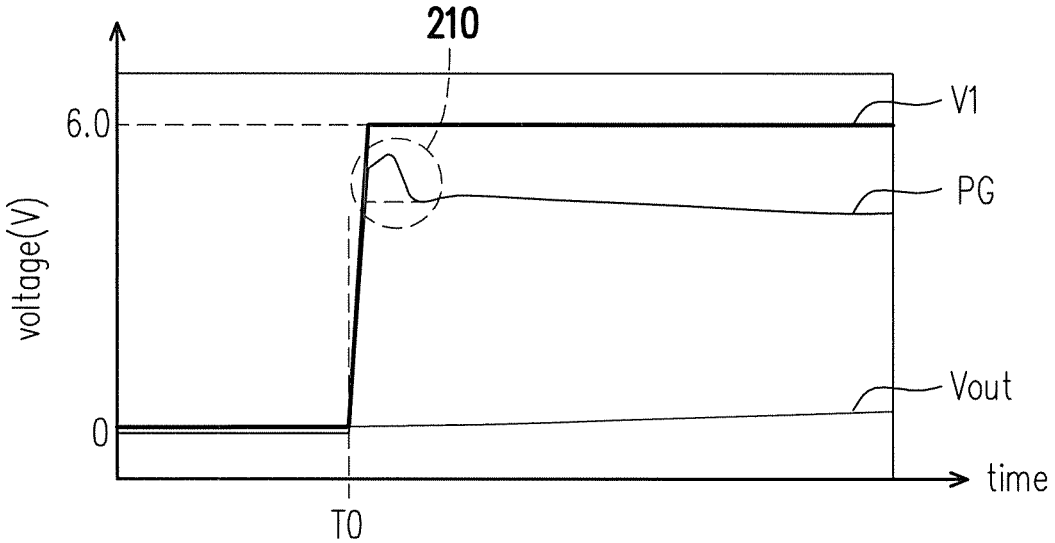
FIG. 2 (PRIOR ART)
FIG. 2 is a waveform view illustrating selected signals of the voltage regulator in operation in FIG. 1.

FIG. 2 is a waveform view illustrating selected signals of the voltage regulator 100 in operation in FIG. 1. Referring to both FIG. 1 and FIG. 2, thereby the operation of the voltage regulator 100 is illustrated. The horizontal axis of FIG. 2 represents time, and the vertical axis of FIG. 2 represents voltage value. At a start-up time T0, the voltage V1 is rapidly increased from 0 v to close to 6 v for supplying power to the voltage regulator 100. An initial state of the transistor M1 is set to be in a cut-off state, so the level of the operating signal PG is increased toward a high level at the start-up time T0, and the damping effect of the voltage regulator 100 causes the operating signal PG to oscillate (shown as the dotted circle 210). Since the primary driving circuit 110 which is still capable of operating normally at a very low current has a slower response speed, and a larger size of the transistor M1 is adopted in order to make it possible for the transistor M1 to flow through a larger output current Io in the disclosure, the ability of the primary driving circuit 110 for driving the transistor M1 is weak, and the level of the operation signal PG is slowly decreased. Therefore, the transistor M1 is conducted slowly, that is, it takes longer time for the transistor M1 to be fully conducted. On the other hand, the level of the output voltage Vout is slowly increased from 0 v corresponding to the level of the operating signal PG which is slowly decreased, resulting in the fact that it takes longer time for the voltage regulator 100 to increase the output voltage Vout to the required voltage value. Moreover, the voltage V1 is equivalent to a voltage on the first terminal SN of the transistor M1, and the output voltage Vout is equivalent to a voltage on the second terminal DN of the transistor M1. It can be seen from FIG. 2 that the slowly increasing level of the output voltage Vout subjects the transistor M1 to withstanding a large voltage difference for a long time, and the transistor M1 therefore suffers risk of damage.

Figure 3:
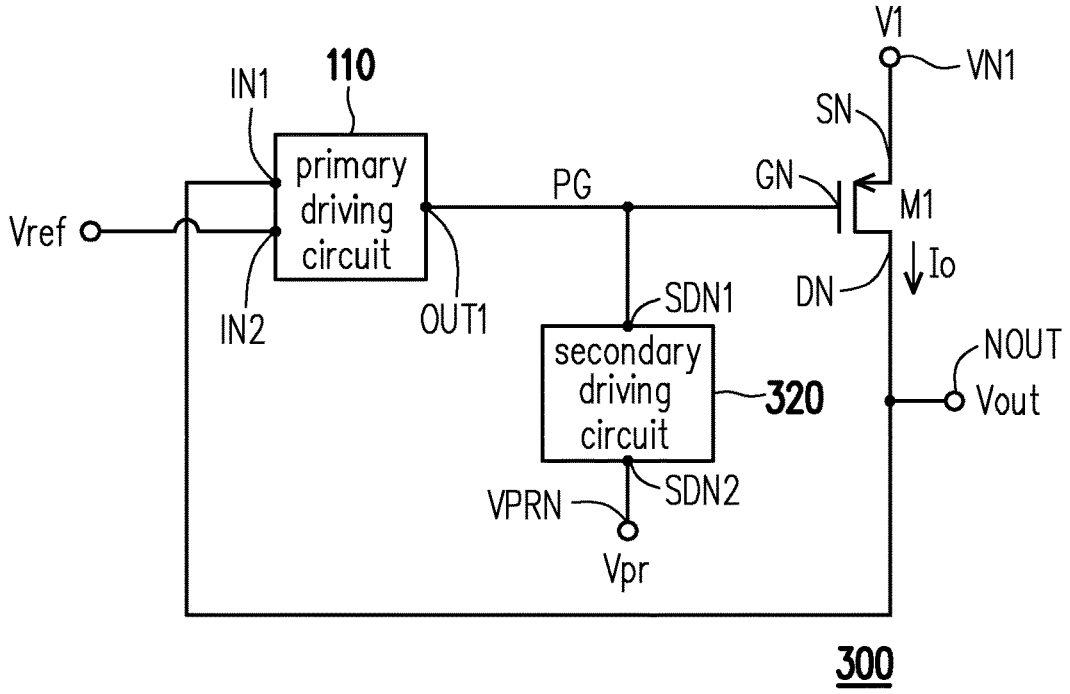
FIG. 3 is a block view of a voltage regulator according to a first embodiment of the disclosure.

FIG. 3 is a block view of a voltage regulator 300 according to a first embodiment of the disclosure. The difference between the voltage regulator 300 and 100 is that the voltage regulator 300 further includes a secondary driving circuit 320. The secondary driving circuit 320 includes a first terminal SDN1 and a second terminal SDN2. The first terminal SDN1 of the secondary driving circuit 320 is coupled to the control terminal GN of the transistor M1, and the second terminal SDN2 is coupled to a predetermined voltage terminal VPRN. The predetermined voltage terminal VPRN is adapted to receive a predetermined voltage Vpr. In some embodiments, the predetermined voltage Vpr may be related to the output voltage Vout, or the predetermined voltage Vpr may be the same as the output voltage Vout. Those applying the embodiment may appropriately adjust the voltage relationship between the predetermined voltage Vpr and the output voltage Vout according to their needs. Note that in the embodiment where the predetermined voltage Vpr is set to be the same as the output voltage Vout, the predetermined voltage terminal VPRN may be coupled to the output terminal NOUT of the voltage regulator 300 and may be adapted to receive the output voltage Vout.

When the voltage regulator 300 operates in a start-up mode, the transistor M1 is driven by the primary driving circuit 110 and the secondary driving circuit 320, and the control terminal GN of the transistor M1 and the predetermined voltage terminal VPRN are electrically coupled by the secondary driving circuit 320. When the voltage regulator 300 operates in a normal mode, the transistor M1 is driven by the primary driving circuit 110, and an electrical coupling between the control terminal GN of the transistor M1 and the predetermined voltage terminal VPRN is disconnected by the secondary driving circuit 320. In some embodiments, the voltage regulator 300 may selectively operate in the start-up mode or in the normal mode according to the output voltage Vout, the predetermined voltage Vpr, or the voltage V1. The secondary driving circuit 320 may determine the operation mode of the voltage regulator 300 according to the output voltage Vout, the predetermined voltage Vpr, or the voltage V1, and thereby the secondary driving circuit 320 may be selectively electrically coupled the control terminal GN of the transistor M1 to the predetermined voltage terminal VPRN or electrically disconnected the control terminal GN of the transistor M1 from the predetermined voltage terminal VPRN.

Figure 4:
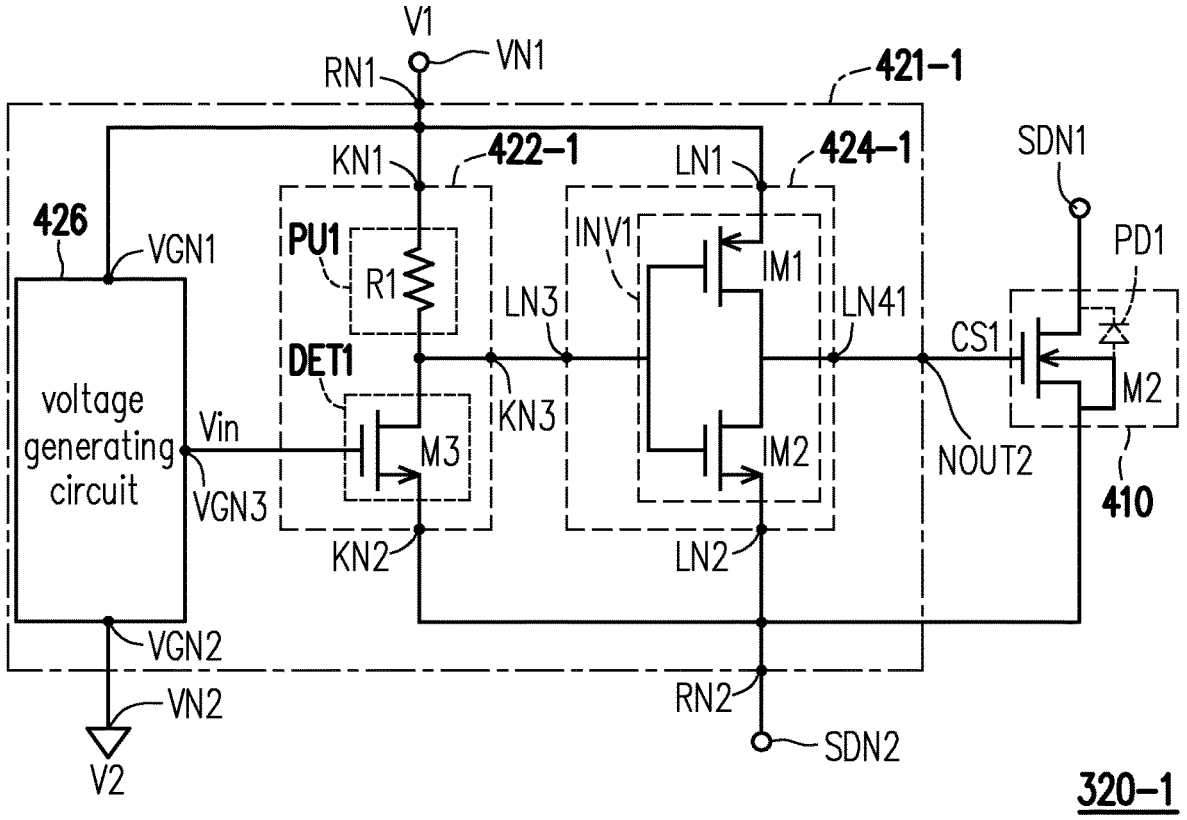
FIG. 4 is a schematic circuit view of a secondary driving circuit in the first embodiment of the disclosure.

In the embodiment, a variety of circuit structures are adapted to implement the secondary driving circuit 320 of the voltage regulator 300, which is explained one by one below as examples. FIG. 4 is a schematic circuit view of a secondary driving circuit 320-1 in the first embodiment of the disclosure. The first terminal SDN1 and the second terminal SDN2 of the secondary driving circuit 320-1 respectively correspond to the first terminal SDN1 and the second terminal SDN2 of the secondary driving circuit 320 in FIG. 3. The secondary driving circuit 320-1 includes a switch 410. A first terminal of the switch 410 is coupled to the first terminal SDN1 of the secondary driving circuit 320-1, a second terminal is coupled to the second terminal SDN2 of the secondary driving circuit 320-1, and a control terminal is adapted for receiving a control signal CS1. The control signal CS1 is adapted to control the turn-on state of the switch 410, and thereby the switch 410 may be selectively electrically coupled the control terminal GN of the transistor M1 to the predetermined voltage terminal VPRN or electrically disconnected the control terminal GN of the transistor M1 from the predetermined voltage terminal VPRN. In other words, the control signal CS1 is related to the operation mode of the voltage regulator 300. The control signal CS1 may be provided by the internal circuit of the secondary driving circuit 320-1 or by an external circuit other than the secondary driving circuit 320-1.

The control signal CS1 provided by the internal circuit of the secondary driving circuit 320-1 is illustrated as an example in FIG. 4. The secondary driving circuit 320-1 further includes a control circuit 421-1. The control circuit 421-1 includes a receiving terminal RN1, a receiving terminal RN2, and an output terminal NOUT2. The receiving terminal RN1 of the control circuit 421-1 is coupled to the voltage terminal VN1 and is adapted for receiving the voltage V1. The receiving terminal RN2 of the control circuit 421-1 is coupled to the second terminal SDN2 of the secondary driving circuit 320-1 and is adapted for receiving the predetermined voltage Vpr. The output terminal NOUT2 of the control circuit 421-1 is coupled to the control terminal of the switch 410 and is adapted for outputting the control signal CS1.

The detailed circuit configuration of the control circuit 421-1 is illustrated below. The control circuit 421-1 includes a trigger circuit 422-1. The trigger circuit 422-1 includes a first terminal KN1, a second terminal KN2, and an output terminal KN3. The first terminal KN1 of the trigger circuit 422-1 is coupled to the receiving terminal RN1 of the control circuit 421-1, the second terminal KN2 is coupled to the receiving terminal RN2 of the control circuit 421-1, and the output terminal KN3 is coupled to the output terminal NOUT2 of the control circuit 421-1.

Specifically, the trigger circuit 422-1 includes a pull-up circuit PU1 and a detection circuit DET1. The pull-up circuit PU1 includes a first terminal and a second terminal. The first terminal of the pull-up circuit PU1 is coupled to the first terminal KN1 of the trigger circuit 422-1, and the second terminal is coupled to the output terminal KN3 of the trigger circuit 422-1. The pull-up circuit PU1 may include a resistor or a current source. The pull-up circuit PU1 including a resistor R1 is illustrated as an example in FIG. 4.

The detection circuit DET1 includes a first terminal, a second terminal, and an input terminal. The first terminal of the detection circuit DET1 is coupled to the second terminal of the pull-up circuit PU1, the second terminal is coupled to the second terminal KN2 of the trigger circuit 422-1, and the input terminal is adapted to receive an input voltage Vin. The input voltage Vin may be a fixed voltage or a variable voltage. Moreover, the input voltage Vin may be provided by the internal circuit of the control circuit 421-1 or by an external circuit other than the control circuit 421-1. The detection circuit DET1 may include a transistor M3. The transistor M3 may be implemented by an NMOS transistor, an NFET, or an NPN type BJT. In the embodiment, the transistor M3 including an NMOS transistor is illustrated as an example. The transistor M3 includes a first terminal, a second terminal, and a control terminal. The first terminal of the transistor M3 is, for example, a drain terminal; the second terminal is, for example, a source terminal; and the control terminal is, for example, a gate terminal. The first terminal of the transistor M3 is coupled to the first terminal of the detection circuit DET1, the second terminal is coupled to the second terminal of the detection circuit DET1, and the control terminal is coupled to the input terminal of the detection circuit DET1.

In the embodiment, the control circuit 421-1 may determine the operation mode of the voltage regulator 300 according to the output voltage Vout, the predetermined voltage Vpr, or the voltage V1, and outputs the control signal CS1 accordingly. Specifically, by the trigger circuit 422-1, the control circuit 421-1 may determine the operation mode of the voltage regulator 300 and outputs the control signal CS1 accordingly. Furthermore, the predetermined voltage Vpr set to be the same as the output voltage Vout and the input voltage Vin set as a fixed voltage are illustrated as examples in FIG. 4. Referring to both FIG. 3 and FIG. 4, the second terminal KN2 of the trigger circuit 422-1 is adapted to receive the predetermined voltage Vpr. In other words, a voltage on the second terminal of the transistor M3 is related to the predetermined voltage Vpr, that is, in the embodiment, the voltage on the second terminal of the transistor M3 is related to the output voltage Vout. In this way, the operation mode of the voltage regulator 300 may be determined by the relationship between the voltage on the second terminal of the transistor M3 and a set threshold value. Note that when the voltage on the second terminal of the transistor M3 is less than the threshold value, the control circuit 421-1 may determine that the voltage regulator 300 operates in the start-up mode; and when the voltage on the second terminal of the transistor M3 is greater than the threshold value, the control circuit 421-1 may determine that the voltage regulator 300 operates in the normal mode. The threshold value of the embodiment is set as a difference between the input voltage Vin and a turn-on voltage of the transistor M3. Those applying the embodiment may also adjust the threshold value by changing the circuit structure of the trigger circuit 422-1.

The switch 410 includes a transistor M2. The transistor M2 may be implemented by an NMOS transistor, an NFET, an NPN-type BJT, a PMOS transistor, a PFET, a PNP-type BJT. The transistor M2 as an NMOS transistor is illustrated as an example in FIG. 4. Note that when the transistor M2 is implemented by an NMOS transistor, an NFET, or an NPN-type BJT, the control circuit 421-1 further includes a logic circuit 424-1 to provide the control signal CS1 with an appropriate level to the transistor M2. In the embodiment, the output terminal KN3 of the trigger circuit 422-1 is coupled to the output terminal NOUT2 of the control circuit 421-1 through the logic circuit 424-1. The logic circuit 424-1 includes a first terminal LN1, a second terminal LN2, an input terminal LN3, and an output terminal LN41. The first terminal LN1 of the logic circuit 424-1 is coupled to the receiving terminal RN1 of the control circuit 421-1, the second terminal LN2 is coupled to the receiving terminal RN2 of the control circuit 421-1, the input terminal LN3 is coupled to the output terminal KN3 of the trigger circuit 422-1, and the output terminal LN41 is coupled to the output terminal NOUT2 of the control circuit 421-1. The logic circuit 424-1 includes an inverter INV1. A first terminal of the inverter INV1 is coupled to the first terminal LN1 of the logic circuit 424-1, a second terminal is coupled to the second terminal LN2 of the logic circuit 424-1, an input terminal is coupled to the input terminal LN3 of the logic circuit 424-1, and an output terminal is coupled to the output terminal LN41 of the logic circuit 424-1. The inverter INV1 may be implemented by transistors IM1 and IM2. The transistor IM1 may be a PMOS transistor, a PFET, or a PNP-type BJT; and the transistor IM2 may be an NMOS transistor, an NFET, or an NPN-type BJT. In other words, when the transistor M2 is implemented by a PMOS transistor, a PFET, or a PNP-type BJT, the logic circuit 424-1 may be omitted, and the trigger circuit 422-1 provides the control signal CS1 with an appropriate level to the transistor M2.

On the other hand, the input voltage Vin provided by the internal circuit of the control circuit 421-1 is illustrated as an example in FIG. 4. The control circuit 421-1 further includes a voltage generating circuit 426. The voltage generating circuit 426 includes a first terminal VGN1, a second terminal VGN2, and an output terminal VGN3. The first terminal VGN1 of the voltage generating circuit 426 is coupled to the receiving terminal RN1 of the control circuit 421-1, the second terminal VGN2 is coupled to a voltage terminal VN2, and the output terminal VGN3 is coupled to the input terminal of the detection circuit DET1 and is adapted for providing the input voltage Vin. The voltage terminal VN2 is adapted to provide a voltage V2, and the voltage V2 may be a ground voltage or other fixed voltages with a low level.

Figure 5:
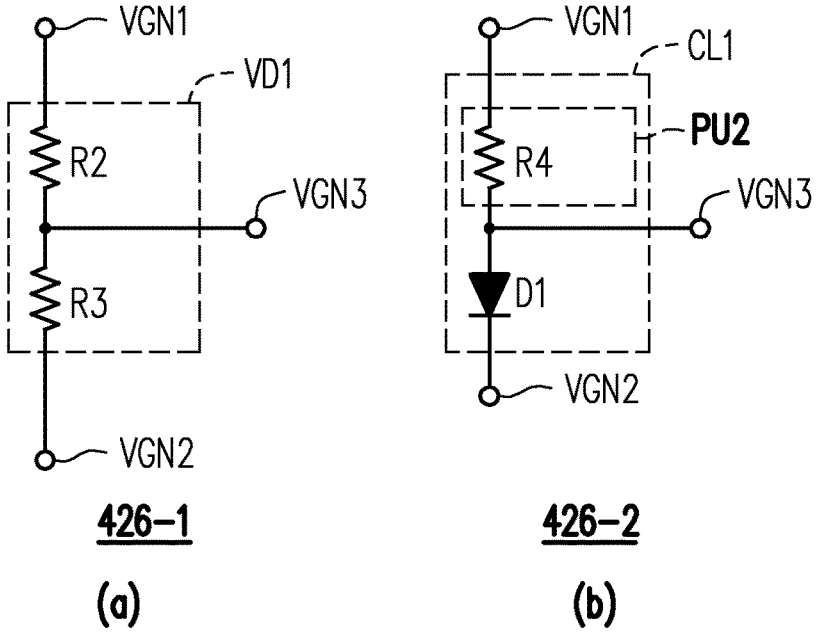
FIG. 5 is a schematic circuit view illustrating the voltage generating circuit in FIG. 4.

FIG. 5 is a schematic circuit view illustrating the voltage generating circuit 426 in FIG. 4. The first terminal VGN1, the second terminal VGN2, and the output terminal VGN3 of the voltage generating circuit 426-1 in part (a) of FIG. 5 correspond to the first terminal VGN1, the second terminal VGN2, and the output terminal VGN3 of the voltage generating circuit 426 in FIG. 4, respectively. The voltage generating circuit 426-1 includes a voltage dividing circuit VD1. The voltage dividing circuit VD1 includes resistors R2 and R3. The resistors R2 and R3 respectively include a first terminal and a second terminal. The first terminal of the resistor R2 is coupled to the first terminal VGN1 of the voltage generating circuit 426-1, and the second terminal is coupled to the output terminal VGN3 of the voltage generating circuit 426-1. The first terminal of the resistor R3 is coupled to the second terminal of the resistor R2, and the second terminal is coupled to the second terminal VGN2 of the voltage generating circuit 426-1. Those applying the embodiment may adjust the resistance of the resistors R2 and R3 appropriately, or they may select the resistors R2 and R3 with appropriate resistances, so that the voltage generating circuit 426-1 provides an appropriate input voltage Vin at the output terminal VGN3.

The first terminal VGN1, the second terminal VGN2, and the output terminal VGN3 of the voltage generating circuit 426-2 in part (b) of FIG. 5 correspond to the first terminal VGN1, the second terminal VGN2, and the output terminal VGN3 of the voltage generating circuit 426 in FIG. 4, respectively. The voltage generating circuit 426-2 includes a clamp circuit CL1. The clamp circuit CL1 includes a pull-up circuit PU2 and a diode D1. The pull-up circuit PU2 and the diode D1 respectively include a first terminal and a second terminal. The first terminal of the pull-up circuit PU2 is coupled to the first terminal VGN1 of the voltage generating circuit 426-2, and the second terminal is coupled to the output terminal VGN3 of the voltage generating circuit 426-2. The pull-up circuit PU2 of the embodiment may be implemented by a resistor R4. The first terminal of the diode D1 is coupled to the second terminal of the pull-up circuit PU2, and the second terminal is coupled to the second terminal VGN2 of the voltage generating circuit 426-2. Those applying the embodiment may select the resistor R4 with a proper resistance and the diode D1 with a proper forward bias so that the voltage generating circuit 426-2 provides an appropriate input voltage Vin at the output terminal VGN3. In addition, although the embodiment adopts a single diode D1 to implement the clamp circuit CL1, in the embodiment, multiple diodes may be connected in series to implement the clamp circuit CL1.

Figure 6:
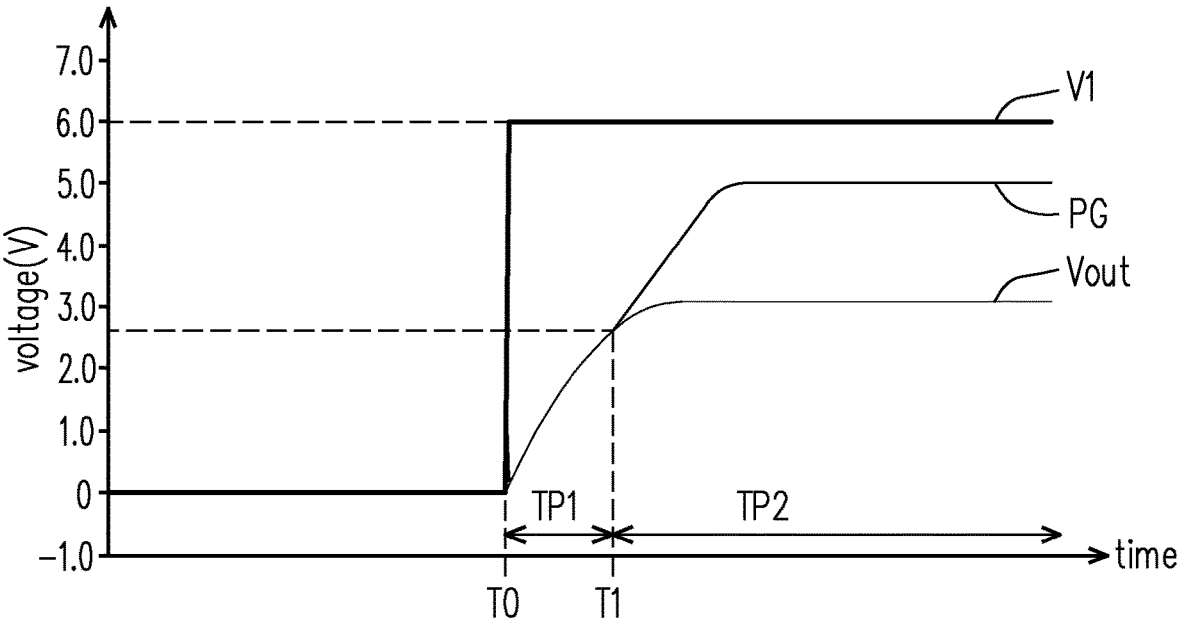
FIG. 6 is a waveform view illustrating selected signals of the voltage regulator in operation in FIG. 3.

FIG. 6 is a waveform view illustrating selected signals of the voltage regulator 300 in operation in FIG. 3. Referring to FIG. 3, FIG. 4, and FIG. 6 altogether, thereby the operation mode of the voltage regulator 300 is illustrated. The horizontal axis of FIG. 6 represents time, and the vertical axis of FIG. 6 represents voltage value. At the start-up time T0, the voltage V1 is rapidly increased from 0 v to close to 6 v for supplying power to the voltage regulator 300. The initial state of the transistor M1 is set to be in the cut-off state, so the level of the operating signal PG is increased toward a high level at the start-up time T0. However, at this time, the voltage on the second terminal of the transistor M3 is less than the difference between the input voltage Vin and the turn-on voltage of the transistor M3, and the control circuit 421-1 may determine that the voltage regulator 300 operates in a start-up mode TP1. Accordingly, the transistor M3 is in a turn-on state, so that a voltage at the input terminal LN3 of the logic circuit 424-1 is pulled down to close to the predetermined voltage Vpr and has a low level, and the output terminal LN41 of the logic circuit 424-1 provides the control signal CS1 with a high level, thereby turning on the transistor M2. The control terminal GN of the transistor M1 and the predetermined voltage terminal VPRN are electrically coupled by the turn-on transistor M2. In other words, the control terminal GN of the transistor M1 is short-circuited to the predetermined voltage terminal VPRN. Therefore, the level of the operating signal PG, which should have continued to be increased toward the high level, is quickly pulled down to a level close to the predetermined voltage Vpr, and the transistor M1 is quickly turned on. On the other hand, the level of the output voltage Vout is increased rapidly from 0 v corresponding to the rapidly falling level of the operating signal PG, so the voltage regulator 300 is capable of increasing the output voltage Vout to the required voltage value in a short time. That is, in the start-up mode TP1, through driving the transistor M1 by the primary driving circuit 110 and one of the secondary driving circuit 320 and the secondary driving circuit 320-1 together, the time for the output voltage Vout to be increased to the required voltage value is shortened. Note that since the predetermined voltage Vpr of the embodiment is set to be the same as the output voltage Vout, in the start-up mode TP1, the level of the operating signal PG varies with the level of the output voltage Vout. The curve of the operating signal PG in FIG. 6 partially coincides with the curve of the output voltage Vout. Moreover, the operating signal PG is less likely to oscillate because its level is quickly pulled down to a low level. In addition to that, the voltage V1 is equivalent to the voltage on the first terminal SN of the transistor M1, and the output voltage Vout is equivalent to the voltage on the second terminal DN of the transistor M1. From FIG. 6, it is seen that the quickly increased level of the output voltage Vout subjects the transistor M1 to withstanding a smaller voltage difference, reducing the risk of damage to the transistor M1.

When the voltage on the second terminal of the transistor M3 is greater than the difference between the input voltage Vin and the turn-on voltage of the transistor M3, the control circuit 421-1 may determine that the voltage regulator 300 operates in a normal mode TP2 (i.e., the voltage regulator 300 enters a working time T1). Accordingly, the transistor M3 is in the cut-off state, so that the voltage at the input terminal LN3 of the logic circuit 424-1 is pulled up to close to the voltage V1 and has a high level, and the output terminal LN41 of the logic circuit 424-1 provides the control signal CS1 with a low level, thereby turning off the transistor M2. The electrical coupling between the control terminal GN of the transistor M1 and the predetermined voltage terminal VPRN is disconnected by the cut-off transistor M2. In other words, in the normal mode TP2, the primary driving circuit 110 drives the transistor M1, and the secondary driving circuit 320 or 320-1 is less likely to affect the control loop between the primary driving circuit 110 and the transistor M1. It is known that with the proper design of the primary driving circuit 110, the voltage regulator 300 not only has a characteristic of low power but is also capable of adjusting the output voltage Vout to the desired voltage value in a short time with the disposition of the secondary driving circuit 320 or 320-1. In short, the voltage regulator 300 has a characteristic of fast activation.

In FIG. 4, the transistor M2 includes a first terminal, a second terminal, a third terminal, and a control terminal. The first terminal of the transistor M2 is, for example, a drain terminal; the second terminal is, for example, a source terminal; the third terminal is, for example, a bulk terminal; and the control terminal is, for example, a gate terminal. The first terminal of the transistor M2 is coupled to the first terminal of the switch 410, the second terminal is coupled to the second terminal of the switch 410, the third terminal is electrically floating or is coupled to the second terminal of the transistor M2 (i.e., the third terminal and the second terminal of the transistor M2 are short-circuited together), and the control terminal is coupled to the control terminal of the switch 410. In the embodiment, the third terminal of the transistor M2 coupled to the second terminal of the transistor M2 is illustrated as an example. In the embodiment, a parasitic diode PD1 exists between the first terminal and the third terminal of the transistor M2, and the anode and the cathode of the parasitic diode PD1 are respectively connected to the third terminal and the first terminal of the transistor M2. In detail, referring to both FIG. 3 and FIG. 4, for example, when the voltage regulator 300 operates in the normal mode, e.g., the output voltage Vout has been adjusted to the required voltage value, if the load is heavy at this time, the load draws more output current Io, causing the voltage value of the output voltage Vout to be decreased. The voltage regulator 300 then adjusts the voltage of the operating signal PG to a lower voltage value to provide more output current Io. Although the transistor M2 in the normal mode is the cut-off state, however, when the difference between the voltage value of the output voltage Vout and the voltage value of the operating signal PG is greater than a turn-on voltage of the parasitic diode PD1 of the transistor M2, a conduction path may be formed by the parasitic diode PD1 of the transistor M2, and thus part of the output current Io is improperly leaked from the output terminal NOUT to the control terminal GN of the transistor M1 through the parasitic diode PD1 of the transistor M2, thereby increasing the voltage value of the operating signal PG and affecting the ability of the primary driving circuit 110 to drive the transistor M1.

Figure 7:
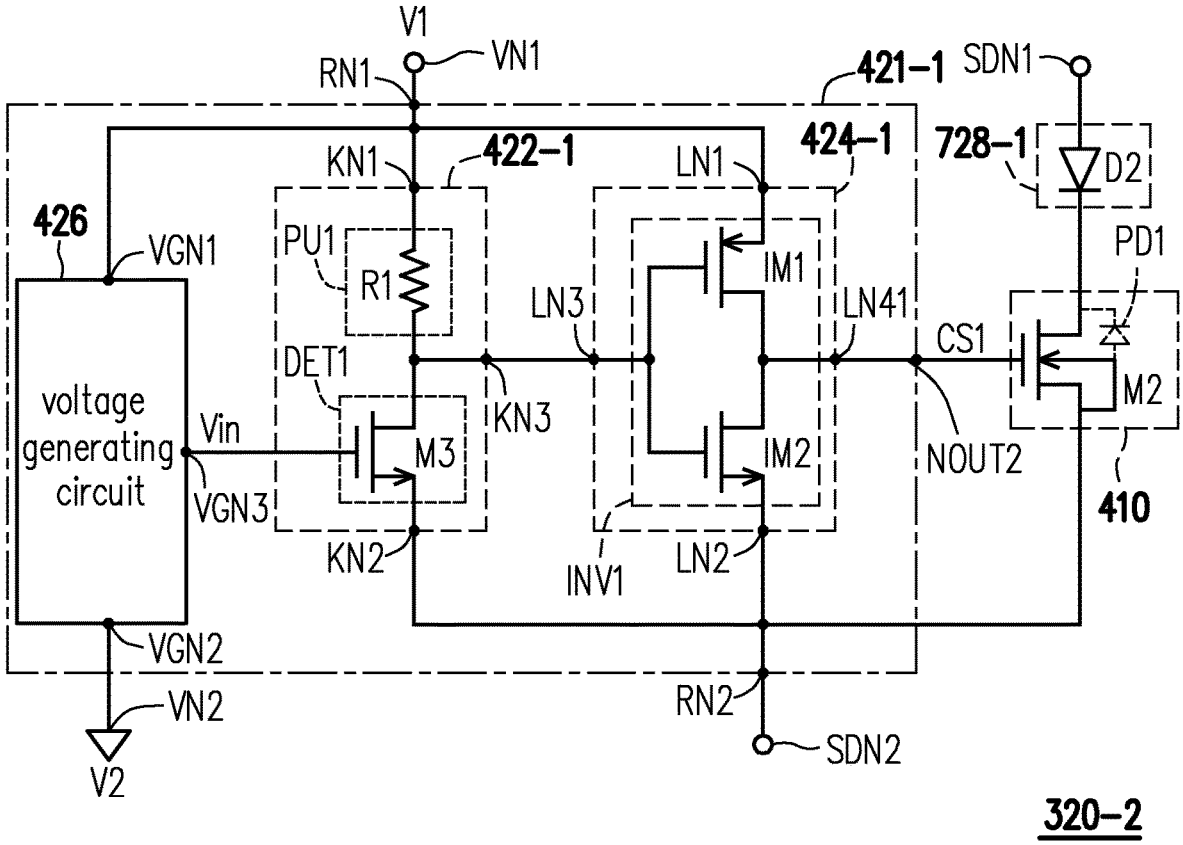
FIG. 7 is a schematic circuit view of another secondary driving circuit in the first embodiment of the disclosure.

To improve this situation, the secondary driving circuit of the embodiment further includes a PN junction element. The PN junction element and the parasitic diode PD1 of the transistor M2 may be connected in series between the first terminal SDN1 and the second terminal SDN2 of the secondary driving circuit in a manner of the back to back. For example, the manner of the back to back may be understood as a configuration that one terminal of the PN junction element is coupled to the terminal of the parasitic diode PD1 with the same polarity. In the embodiment, the PN junction element may be implemented by a variety of circuit structures, which is illustrated one by one below. FIG. 7 is a schematic circuit view of another secondary driving circuit 320-2 in the first embodiment of the disclosure. The difference between the secondary driving circuit 320-2 and 320-1 is that the secondary driving circuit 320-2 further includes a PN junction element 728-1. The PN junction element 728-1 includes a first terminal and a second terminal. The first terminal of the PN junction element 728-1 is coupled to the first terminal SDN1 of the secondary driving circuit 320-2, and the second terminal is coupled to the first terminal of the transistor M2. The PN junction element 728-1 may include a diode or a transistor. The PN junction element 728-1 including a diode D2 is illustrated as an example in FIG. 7. The anode of the diode D2 is coupled to the first terminal of the PN junction element 728-1, and the cathode is coupled to the second terminal of the PN junction element 728-1. Specifically, the cathode of the diode D2 is coupled to the cathode of the parasitic diode PD1, that is, the diode D2 and the parasitic diode PD1 are connected in series between the first terminal SDN1 and the second terminal SDN2 of the secondary driving circuit 320-2 in the manner of the back to back. In this way, the turn-on voltage of the transistor M2 is increased by the diode D2, so that the output current Io is not easily leaked to the control terminal GN of the transistor M1 through the parasitic diode PD1 of the transistor M2. In some embodiments, the diode D2 may be replaced with a diode connected transistor.

Figure 8:
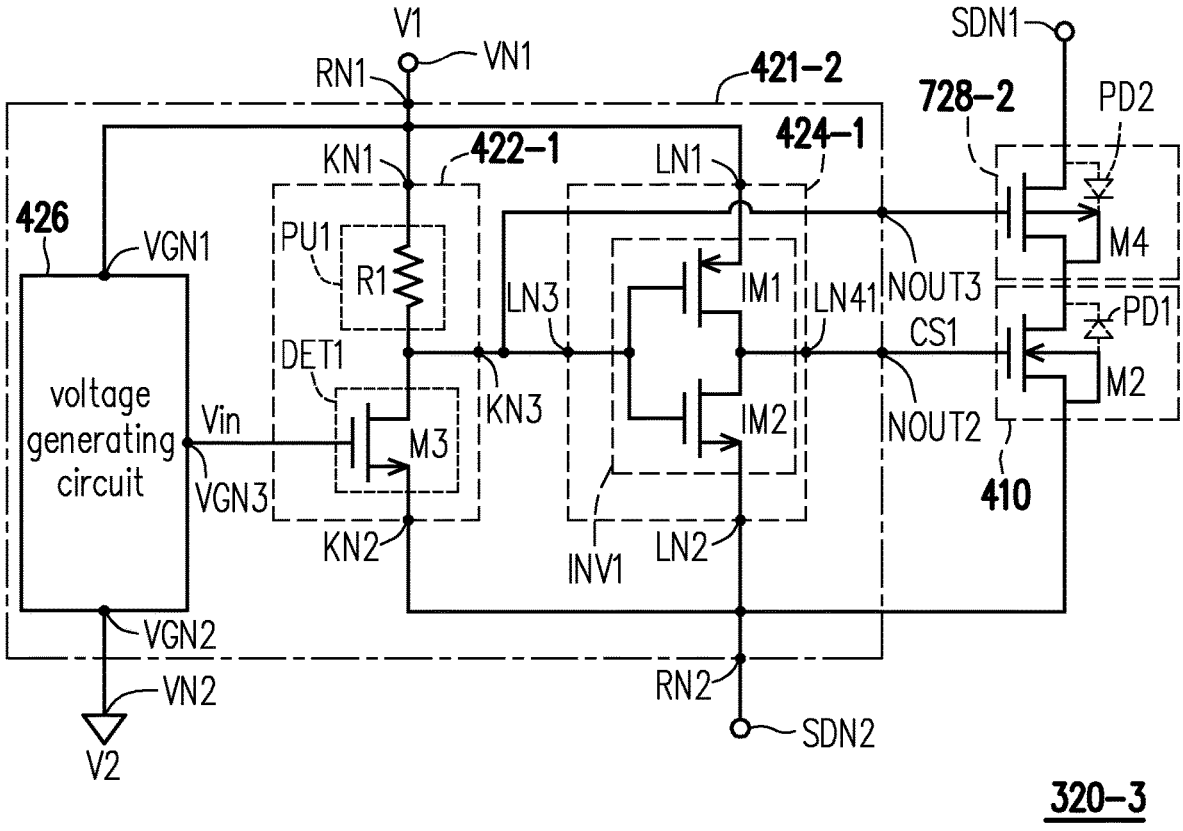
FIG. 8 is a schematic circuit view of another secondary driving circuit in the first embodiment of the disclosure.

FIG. 8 is a schematic circuit view of another secondary driving circuit 320-3 in the first embodiment of the disclosure. The difference between the secondary driving circuit 320-3 and 320-2 lies in the circuit structure of the control circuit 421-2 of the secondary driving circuit 320-3 and the circuit structure of the PN junction element 728-2. The control circuits 421-2 and 421-1 include similar elements, but the control circuit 421-2 further includes an output terminal NOUT3. The output terminal KN3 of the trigger circuit 422-1 is further coupled to the output terminal NOUT3 of the control circuit 421-2.

On the other hand, the PN junction element 728-2 in FIG. 8 includes a transistor M4. The transistor M4 may be implemented by a PMOS transistor, a PFET, or a PNP-type BJT. The transistor M4 includes a first terminal, a second terminal, a third terminal, and a control terminal. The first terminal of the transistor M4 is coupled to the first terminal of the PN junction element 728-2, the second terminal is coupled to the second terminal of the PN junction element 728-2, the third terminal is electrically floating or is coupled to the second terminal of the transistor M4, and the control terminal is coupled to the output terminal NOUT3 of the control circuit 421-2. In other words, the control terminal of the transistor M4 is coupled to the output terminal KN3 of the trigger circuit 422-1 through the output terminal NOUT3 of the control circuit 421-2. In this way, the trigger circuit 422-1 provides a signal with an appropriate level to the control terminal of the transistor M4 to control the turn-on state of the transistor M4. Note that the transistors M2 and M4 in the start-up mode are both in the turn-on state and the transistors M2 and M4 in the normal mode are both in the cut-off state, but the level of the control signal CS1 and the level of the signal received by the control terminal of the transistor M4 are opposite.

In the embodiment, the transistor M4 including a PMOS transistor and the third terminal of the transistor M4 coupled to its second terminal are illustrated as examples. The first terminal of the transistor M4 is, for example, the source terminal; the second terminal is, for example, a drain terminal; the third terminal is, for example, a bulk terminal; and the control terminal is, for example, a gate terminal. In the embodiment, a parasitic diode PD2 exists between the first terminal and the third terminal of the transistor M4, and the anode and the cathode of the parasitic diode PD2 are respectively connected to the first terminal and the third terminal of the transistor M4. Specifically, the cathode of the parasitic diode PD2 is coupled to the cathode of the parasitic diode PD1, that is, the parasitic diodes PD2 and PD1 are connected in series between the first terminal SDN1 and the second terminal SDN2 of the secondary driving circuit 320-3 in the manner of the back to back. In this way, the turn-on voltage of the transistor M2 is increased by the parasitic diode PD2, so that the output current Io is not easily leaked to the control terminal GN of the transistor M1 through the parasitic diode PD1 of the transistor M2. Note that the disclosure does not limit the type of manufacturing process for transistors M4 and M2 (e.g., the transistors M4 and M2 may be manufactured by a silicon on insulator (SOI) process or by a bulk complementary metal-oxide-semiconductor (Bulk CMOS) process), as long as the parasitic diode of the transistor M4 and the parasitic diode of the transistor M2 are connected in series between the first terminal SDN1 and the second terminal SDN2 of the secondary driving circuit 320-3 in the manner of the back to back. For example, this may be achieved by electrically floating the third terminal of the transistor M4 or coupling the third terminal of the transistor M4 to its second terminal, and/or electrically floating the third terminal of transistor M2 or coupling the third terminal of transistor M2 to its second terminal. In some embodiments, when the transistor M2 is manufactured by the SOI process or by the Bulk CMOS process, and the third terminal of the transistor M2 is electrically floating, the PN junction element 728-1 or the PN junction element 728-2 may be omitted.

Figure 9:
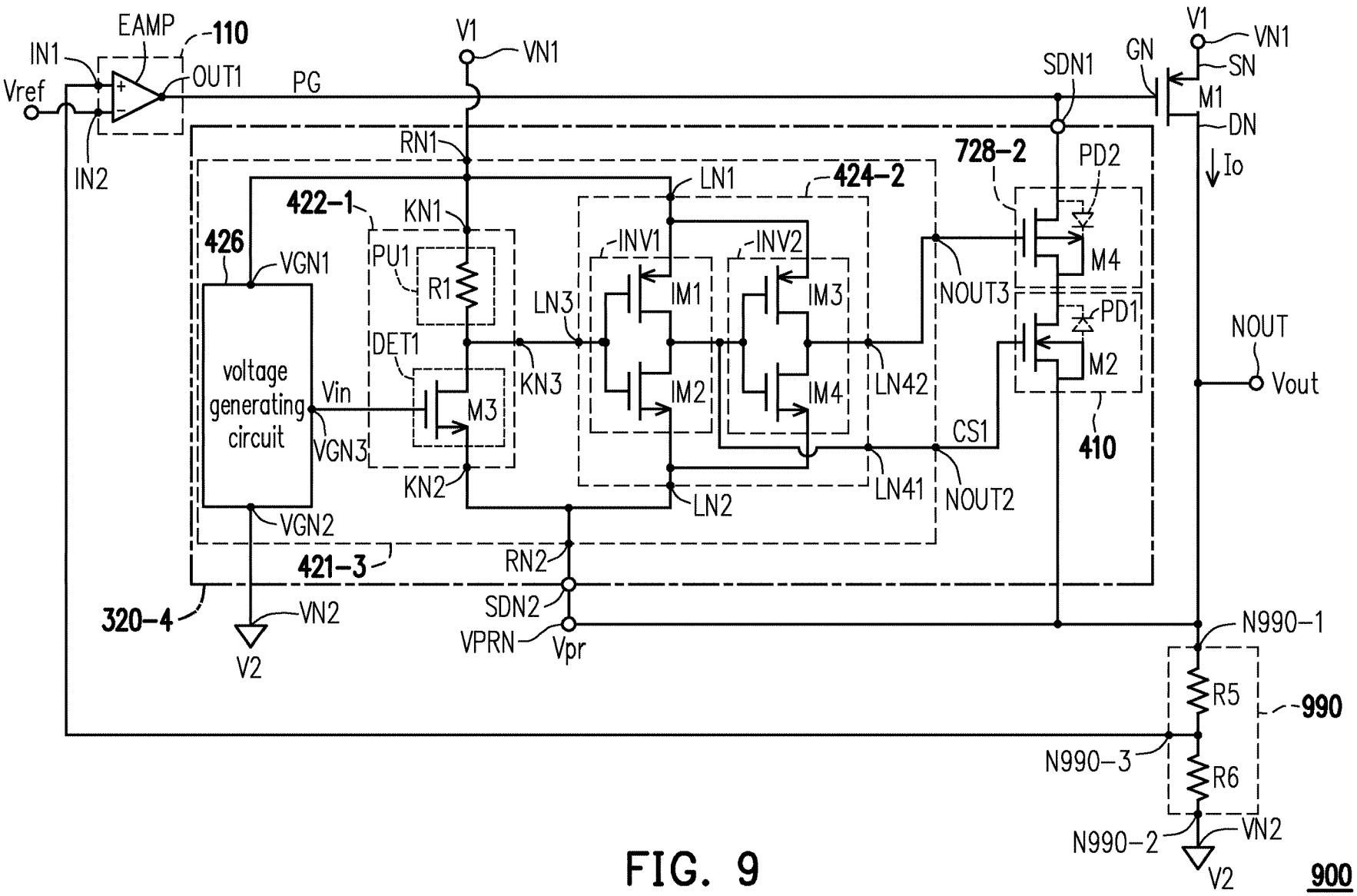
FIG. 9 is a block view of a voltage regulator according to a second embodiment of the disclosure.

FIG. 9 is a block view of a voltage regulator 900 according to a second embodiment of the disclosure. The difference between the voltage regulator 900 and 300 is that the voltage regulator 900 further includes a voltage dividing circuit 990. The voltage dividing circuit 990 includes a first terminal N990-1, a second terminal N990-2, and an output terminal N990-3. The first terminal N990-1 of the voltage dividing circuit 990 is coupled to the output terminal NOUT of the voltage regulator 900, the second terminal N990-2 is coupled to the voltage terminal VN2, and the output terminal N990-3 is coupled to the input terminal IN1 of the primary driving circuit 110. The voltage dividing circuit 990 may be implemented by resistors R5 and R6 connected in series. In this way, those applying the embodiment can appropriately adjust the resistance values of the resistors R5 and R6 (e.g., adjust the resistance ratio between the resistors R5 and R6) according to their needs, so that the voltage value of the output voltage Vout is adjusted.

On the other hand, the difference between the secondary driving circuit 320-4 and 320-3 lies in the circuit structure of the logic circuit 424-2 of the control circuit 421-3 and the connection method of the output terminal NOUT3 of the control circuit 421-3. In FIG. 9, the logic circuit 424-2 further includes an output terminal LN42 and an inverter INV2. The output terminal LN42 of the logic circuit 424-2 is coupled to the output terminal NOUT3 of the control circuit 421-3. A first terminal of the inverter INV2 is coupled to the first terminal LN1 of the logic circuit 424-2, a second terminal is coupled to the second terminal LN2 of the logic circuit 424-2, an input terminal is coupled to the output terminal of the inverter INV1, and an output terminal is coupled to the output terminal LN42 of the logic circuit 424-2. The inverter INV2 may be implemented by transistors IM3 and IM4. The transistor IM3 may be a PMOS transistor, a PFET, or a PNP-type BJT; and transistor IM4 may be an NMOS transistor, an NFET, or an NPN-type BJT. In addition, in the embodiment, the control terminal of the transistor M4 is coupled to the output terminal NOUT3 of the control circuit 421-3; in this way, the inverter INV2 provides a signal with an appropriate level to the control terminal of the transistor M4 to control the turn-on state of the transistor M4, and the inverter INV1 provides the control signal CS1 with an appropriate level to the control terminal of the transistor M2 to control the turn-on state of the transistor M2. In addition to that, by the inverter INV2, the speed of driving transistor M4 is improved. Those applying the embodiment may also apply the secondary driving circuit 320-4 in FIG. 9 to the corresponding voltage regulator in accordance with the embodiment of the disclosure. For example, the secondary driving circuit 320 of the voltage regulator 300 in FIG. 3 may be implemented by the secondary driving circuit 320-4.

The primary driving circuit 110 of the voltage regulator 900 in FIG. 9 includes an error amplifier EAMP. The input terminal IN1 of the primary driving circuit 110 is the non-inverting input terminal of the error amplifier EAMP, the input terminal IN2 is the inverting input terminal of the error amplifier EAMP, and the output terminal OUT1 is the output terminal of the error amplifier EAMP.

When the secondary driving circuit 320 of the voltage regulator 300 in FIG. 3 is implemented by the secondary driving circuits 320-1 to 320-4 in FIG. 4, FIG. 7, FIG. 8, or FIG. 9, or when the secondary driving circuit 320-4 of the voltage regulator 900 in FIG. 9 is implemented by the secondary driving circuits 320-1 to 320-3 in FIG. 4, FIG. 7, or FIG. 8, the voltage regulator 300 or the voltage regulator 900 selectively operates in the start-up mode or in the normal mode according to the output voltage Vout, the predetermined voltage Vpr, or the voltage V1. However, in some embodiments, the voltage regulator 300 or the voltage regulator 900 also selectively operates in the start-up mode or in the normal mode according to a set delay time, which is explained one by one below.

Figure 10:
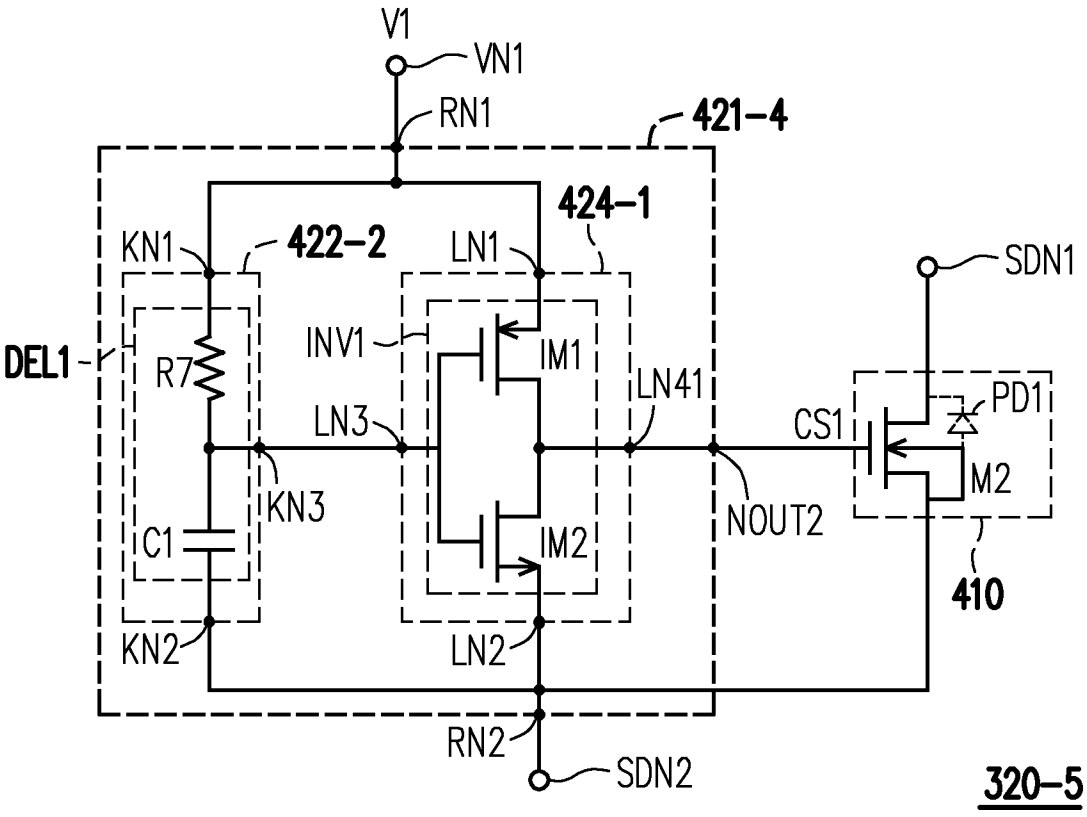
FIG. 10 is a schematic circuit view of another secondary driving circuit in the first embodiment or the second embodiment of the disclosure.

FIG. 10 is a schematic circuit view of another secondary driving circuit 320-5 in the first embodiment or the second embodiment of the disclosure. The difference between the secondary driving circuits 320-5 and 320-1 lies in the circuit structure of the control circuit 421-4 of the secondary driving circuit 320-5. When the secondary driving circuit 320 of the voltage regulator 300 in FIG. 3 or the secondary driving circuit 320-4 of the voltage regulator 900 in FIG. 9 is implemented by the secondary driving circuit 320-5 in FIG. 10, the voltage regulator 300 or 900 selectively operates in the start-up mode or in the normal mode according to the set delay time. The secondary driving circuit 320-5 may determine the operation mode of the voltage regulator 300 or 900 according to the set delay time, thereby the secondary driving circuit 320-5 may be selectively electrically coupled the control terminal GN of the transistor M1 to the predetermined voltage terminal VPRN or electrically disconnected the control terminal GN of the transistor M1 from the predetermined voltage terminal VPRN.

The detailed circuit configuration of the control circuit 421-4 is illustrated. The control circuit 421-4 includes a trigger circuit 422-2. The trigger circuit 422-2 includes a first terminal KN1, a second terminal KN2, and an output terminal KN3. The first terminal KN1 of the trigger circuit 422-2 is coupled to a receiving terminal RN1 of the control circuit 421-4, the second terminal KN2 is coupled to a receiving terminal RN2 of the control circuit 421-4, and the output terminal KN3 is coupled to an output terminal NOUT2 of the control circuit 421-4. In some embodiments, those applying the embodiment may design the second terminal KN2 of the trigger circuit 422-2 to be coupled to the receiving terminal RN2 of the control circuit 421-4 or the voltage terminal VN2 according to their needs.

The trigger circuit 422-2 includes a delay circuit DELL The delay circuit DEL1 includes a first terminal, a second terminal, and an output terminal. The first terminal of the delay circuit DEL1 is coupled to the first terminal KN1 of the trigger circuit 422-2, the second terminal is coupled to the second terminal KN2 of the trigger circuit 422-2, and the output terminal is coupled to the output terminal KN3 of the trigger circuit 422-2. The delay circuit DEL1 includes a resistor R7 and a capacitor C1. The resistor R7 and the capacitor C1 respectively include a first terminal and a second terminal. The first terminal of the resistor R7 is coupled to the first terminal of the delay circuit DEL1, and the second terminal is coupled to the output terminal of the delay circuit DELL The first terminal of the capacitor C1 is coupled to the second terminal of the resistor R7, and the second terminal is coupled to the second terminal of the delay circuit DELL Those applying the embodiment may design the resistance value of the resistor R7 and the capacitance value of the capacitor C1 according to their needs, so as to set the length of the delay time.

The transistor M2 as an NMOS transistor is illustrated as an example in FIG. 10. In the embodiment, the control circuit 421-4 further includes a logic circuit 424-1 to provide a control signal CS1 with an appropriate level to the transistor M2. The output terminal KN3 of the trigger circuit 422-2 is coupled to the output terminal NOUT2 of the control circuit 421-4 through the logic circuit 424-1. The circuit structure of the logic circuit 424-1 is similar to that of the logic circuit 424-1 in FIG. 4, which is not iterated.

The control circuit 421-4 of the embodiment may determine the operation mode of the voltage regulator 300 or 900 according to the set delay time and outputs the control signal CS1 accordingly. In detail, the control circuit 421-4 may determine the operation mode of the voltage regulator 300 or 900 by the delay circuit DEL1 and outputs the control signal CS1 accordingly. Furthermore, since the resistance value of the resistor R7 and the capacitance value of the capacitor C1 of the delay circuit DEL1 are related to the delay time, the operation mode of the voltage regulator 300 or 900 may be determined by the relationship between the voltage on the output terminal of the delay circuit DEL1 and a set threshold value. Note that when the voltage on the output terminal of the delay circuit DEL1 is less than the threshold value (i.e., the set delay time is not reached), the control circuit 421-4 may determine that the voltage regulator 300 or 900 operates in the start-up mode; when the voltage on the output terminal of the delay circuit DEL1 is greater than the threshold value (i.e., the set delay time has been reached), the control circuit 421-4 may determine that the voltage regulator 300 or 900 operates in the normal mode. The threshold value of the embodiment may be set as a transition voltage of the logic circuit 424-1. Those applying the embodiment may also adjust the threshold value by changing the circuit structure of the trigger circuit 422-2.

The operation of the control circuit 421-4 is illustrated below. The predetermined voltage Vpr set to be the same as the output voltage Vout is illustrated as an example in FIG. 10. At the start-up time, the voltage V1 supplies power to the voltage regulator 300 or 900, and the capacitor C1 starts to charge the predetermined voltage Vpr that an initial state thereof is 0 v. That is, in the embodiment, the capacitor C1 starts to charge the output voltage Vout that an initial state thereof is 0 v. Therefore, the voltage on the output terminal of the delay circuit DEL1 is less than the threshold value, and the control circuit 421-4 may determine that the voltage regulator 300 or 900 operates in the start-up mode. Accordingly, the voltage on the input terminal LN3 of the logic circuit 424-1 is pulled down to close to the predetermined voltage Vpr and has a low level, and the output terminal LN41 of the logic circuit 424-1 provides the control signal CS1 with a high level, thereby turning on the transistor M2. As the set delay time passes, the levels of the predetermined voltage Vpr and the output voltage Vout have been increased to close to the required voltage values. Therefore, the voltage on the output terminal of the delay circuit DEL1 is greater than the threshold value, and the control circuit 421-4 may determine that the voltage regulator 300 or 900 operates in the normal mode. Accordingly, the voltage of the input terminal LN3 of the logic circuit 424-1 is pulled up to close to the voltage V1 and has a high level, and the output terminal LN41 of the logic circuit 424-1 provides the control signal CS1 with a low level, thereby turning off the transistor M2.

Figure 11:
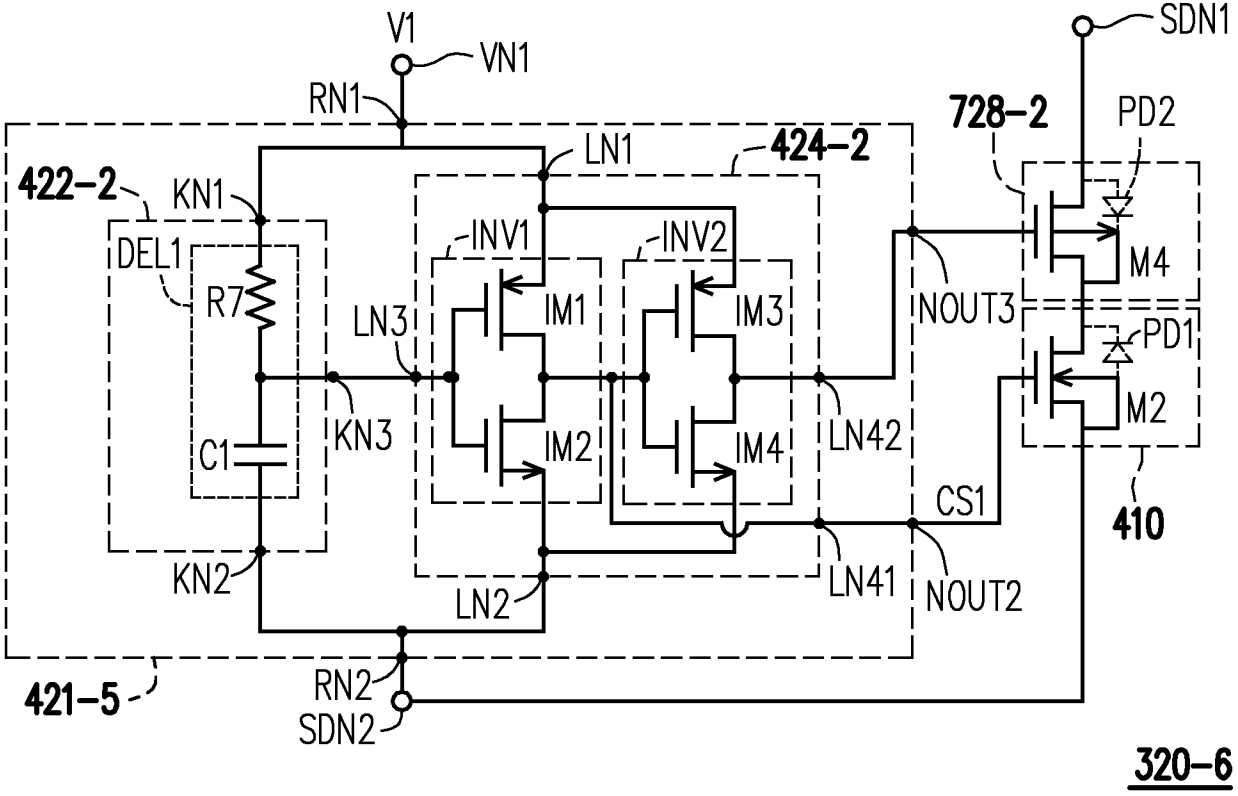
FIG. 11 is a schematic circuit view of another secondary driving circuit in the first embodiment or the second embodiment of the disclosure.

FIG. 11 is a schematic circuit view of another secondary driving circuit 320-6 in the first embodiment or the second embodiment of the disclosure. The difference between the secondary driving circuits 320-6 and 320-5 is that the secondary driving circuit 320-6 further includes a PN junction element 728-2 and the circuit structure of the control circuit 421-5 of the secondary driving circuit 320-6. The PN junction element 728-2, the connection method of the output terminal NOUT3 of the control circuit 421-5, and the circuit structure and function of the logic circuit 424-2 of the control circuit 421-5 in FIG. 11 are similar to the PN junction element 728-2, the output terminal NOUT3 of the control circuit 421-3, and the logic circuit 424-2 in FIG. 9, which are not iterated. In some embodiments, the PN junction element 728-2 may include a diode. In the embodiment, the inverter INV2 of the logic circuit 424-2 may be omitted and refer to FIG. 7 for the circuit structure and related descriptions, which is not iterated. In other embodiments, the control terminal of the transistor M4 may also be coupled to the output terminal KN3 of the trigger circuit 422-2 through the output terminal NOUT3 of the control circuit 421-5. In the embodiment, the inverter INV2 in the logic circuit 424-2 may also be omitted, so that the trigger circuit 422-2 provides a signal with a proper level to the control terminal of the transistor M4, thereby controlling the turn-on state of the transistor M4, and refer to FIG. 8 for the circuit structure and related descriptions, which is not iterated. That is, the circuit structure in FIG. 11 increases the turn-on voltage of the transistor M2 by the PN junction element 728-2, so that the output current Io is not easily leaked to the control terminal GN of the transistor M1 through the parasitic diode PD1 of the transistor M2.

Based on the above, with the proper design of the primary driving circuit, the voltage regulator has not only a characteristic of low power but also a characteristic of fast activation when the voltage regulator operates in the start-up mode, and the voltage value of the output voltage is quickly increased by the primary driving circuit and the secondary driving circuit in the embodiment, and the voltage regulator is capable of reducing risks of transistor damage. On the other hand, when the voltage regulator operates in the normal mode, in the embodiment, the control terminal of the transistor is electrically disconnected from the predetermined voltage terminal by the secondary driving circuit, so that the control loop between the primary driving circuit and the transistor is not easily affected by the secondary driving circuit.

What is claimed is:

1. A voltage regulator, comprising:

an output terminal adapted to output an output voltage;

a first transistor comprising a first terminal, a second terminal, and a control terminal, wherein the first terminal of the first transistor is coupled to a first voltage terminal and is adapted to receive a first voltage, and the second terminal of the first transistor is coupled to the output terminal of the voltage regulator;

a primary driving circuit comprising a first input terminal, a second input terminal, and an output terminal, wherein the first input terminal of the primary driving circuit is coupled to the output terminal of the voltage regulator and is adapted to receive the output voltage, the second input terminal of the primary driving circuit is adapted to receive a reference voltage, and the output terminal of the primary driving circuit is coupled to the control terminal of the first transistor; and a secondary driving circuit comprising a first terminal and a second terminal, wherein the first terminal of the secondary driving circuit is coupled to the control terminal of the first transistor, and the second terminal of the secondary driving circuit is coupled to a predetermined voltage terminal;

wherein when the voltage regulator operates in a start-up mode, the first transistor is driven by the primary driving circuit and the secondary driving circuit, and the control terminal of the first transistor and the predetermined voltage terminal are electrically coupled by the secondary driving circuit; and when the voltage regulator operates in a normal mode, the first transistor is driven by the primary driving circuit, and an electrical coupling between the control terminal of the first transistor and the predetermined voltage terminal is disconnected by the secondary driving circuit.

2. The voltage regulator according to claim 1, wherein the predetermined voltage terminal is adapted to receive a predetermined voltage, and the voltage regulator selectively operates in the start-up mode or in the normal mode according to the output voltage, the predetermined voltage, or the first voltage.

3. The voltage regulator according to claim 1, wherein the predetermined voltage terminal is coupled to the output terminal of the voltage regulator and is adapted to receive the output voltage.

4. The voltage regulator according to claim 1, wherein the secondary driving circuit comprises:

a switch comprising a first terminal, a second terminal, and a control terminal, wherein the first terminal of the switch is coupled to the first terminal of the secondary driving circuit, the second terminal of the switch is coupled to the second terminal of the secondary driving circuit, and the control terminal of the switch is adapted to receive a control signal.

5. The voltage regulator according to claim 4, wherein the secondary driving circuit further comprises:

a control circuit comprising a first receiving terminal, a second receiving terminal, and a first output terminal, wherein the first receiving terminal of the control circuit is coupled to the first voltage terminal, the second receiving terminal of the control circuit is coupled to the second terminal of the secondary driving circuit, and the first output terminal of the control circuit is coupled to the control terminal of the switch and is adapted to output the control signal.

6. The voltage regulator according to claim 5, wherein the control circuit further comprises:

a trigger circuit comprising a first terminal, a second terminal, and an output terminal, wherein the first terminal of the trigger circuit is coupled to the first receiving terminal of the control circuit, the second terminal of the trigger circuit is coupled to the second receiving terminal of the control circuit or a second voltage terminal, and the output terminal of the trigger circuit is coupled to the first output terminal of the control circuit.

7. The voltage regulator according to claim 6, wherein the control circuit further comprises a logic circuit; the output terminal of the trigger circuit is coupled to the first output terminal of the control circuit through the logic circuit; the logic circuit comprises a first terminal, a second terminal, an input terminal, and a first output terminal; the first terminal of the logic circuit is coupled to the first receiving terminal of the control circuit; the second terminal of the logic circuit is coupled to the second receiving terminal of the control circuit; the input terminal of the logic circuit is coupled to the output terminal of the trigger circuit; and the first output terminal of the logic circuit is coupled to the first output terminal of the control circuit.

8. The voltage regulator according to claim 7, wherein the trigger circuit comprises:

a delay circuit comprising a first terminal, a second terminal, and an output terminal, wherein the first terminal of the delay circuit is coupled to the first terminal of the trigger circuit, the second terminal of the delay circuit is coupled to the second terminal of the trigger circuit, and the output terminal of the delay circuit is coupled to the output terminal of the trigger circuit.

9. The voltage regulator according to claim 8, wherein the delay circuit comprises:

a first resistor comprising a first terminal and a second terminal, wherein the first terminal of the first resistor is coupled to the first terminal of the delay circuit, and the second terminal of the first resistor is coupled to the output terminal of the delay circuit; and a first capacitor comprising a first terminal and a second terminal, wherein the first terminal of the first capacitor is coupled to the second terminal of the first resistor, and the second terminal of the first capacitor is coupled to the second terminal of the delay circuit.

10. The voltage regulator according to claim 9, wherein when a voltage on the output terminal of the delay circuit is less than a threshold value, the voltage regulator operates in the start-up mode;

when the voltage on the output terminal of the delay circuit is greater than the threshold value, the voltage regulator operates in the normal mode; and the threshold value is a transition voltage of the logic circuit.

11. The voltage regulator according to claim 7, wherein the switch comprises:

a third transistor comprising a first terminal, a second terminal, a third terminal, and a control terminal, wherein the first terminal of the third transistor is coupled to the first terminal of the switch, the second terminal of the third transistor is coupled to the second terminal of the switch, the third terminal of the third transistor is electrically floating or is coupled to the second terminal of the third transistor, and the control terminal of the third transistor is coupled to the control terminal of the switch, wherein the secondary driving circuit further comprises:

a PN junction element comprising a first terminal and a second terminal, wherein the first terminal of the PN junction element is coupled to the first terminal of the secondary driving circuit, and the second terminal of the PN junction element is coupled to the first terminal of the third transistor.

12. The voltage regulator according to claim 11, wherein the PN junction element comprises a first diode or a fourth transistor.

13. The voltage regulator according to claim 12, wherein the control circuit further comprises a second output terminal; the fourth transistor comprises a first terminal, a second terminal, a third terminal, and a control terminal; the first terminal of the fourth transistor is coupled to the first terminal of the PN junction element; the second terminal of the fourth transistor is coupled to the second terminal of the PN junction element; the third terminal of the fourth transistor is electrically floating or is coupled to the second terminal of the fourth transistor; and the control terminal of the fourth transistor is coupled to the output terminal of the trigger circuit through the second output terminal of the control circuit.

14. The voltage regulator according to claim 12, wherein the control circuit further comprises a second output terminal; the fourth transistor comprises a first terminal, a second terminal, a third terminal, and a control terminal; the first terminal of the fourth transistor is coupled to the first terminal of the PN junction element; the second terminal of the fourth transistor is coupled to the second terminal of the PN junction element; the third terminal of the fourth transistor is electrically floating or is coupled to the second terminal of the fourth transistor; the control terminal of the fourth transistor is coupled to the second output terminal of the control circuit; and the logic circuit comprises:

a second output terminal coupled to the second output terminal of the control circuit;

a first inverter comprising a first terminal, a second terminal, an input terminal, and an output terminal, wherein the first terminal of the first inverter is coupled to the first terminal of the logic circuit, the second terminal of the first inverter is coupled to the second terminal of the logic circuit, the input terminal of the first inverter is coupled to the input terminal of the logic circuit, and the output terminal of the first inverter is coupled to the first output terminal of the logic circuit; and a second inverter comprising a first terminal, a second terminal, an input terminal, and an output terminal, wherein the first terminal of the second inverter is coupled to the first terminal of the logic circuit, the second terminal of the second inverter is coupled to the second terminal of the logic circuit, the input terminal of the second inverter is coupled to the output terminal of the first inverter, and the output terminal of the second inverter is coupled to the second output terminal of the logic circuit.

15. The voltage regulator according to claim 6, wherein the second terminal of the trigger circuit is coupled to the second receiving terminal of the control circuit, and the trigger circuit comprises:

a pull-up circuit comprising a first terminal and a second terminal, wherein the first terminal of the pull-up circuit is coupled to the first terminal of the trigger circuit, and the second terminal of the pull-up circuit is coupled to the output terminal of the trigger circuit; and a detection circuit comprising a first terminal, a second terminal, and an input terminal, wherein the first terminal of the detection circuit is coupled to the second terminal of the pull-up circuit, the second terminal of the detection circuit is coupled to the second terminal of the trigger circuit, and the input terminal of the detection circuit is adapted to receive an input voltage.

16. The voltage regulator according to claim 15, wherein the detection circuit comprises:

a second transistor comprising a first terminal, a second terminal, and a control terminal, wherein the first terminal of the second transistor is coupled to the first terminal of the detection circuit, the second terminal of the second transistor is coupled to the second terminal of the detection circuit, and the control terminal of the second transistor is coupled to the input terminal of the detection circuit.

17. The voltage regulator according to claim 16, wherein when a voltage on the second terminal of the second transistor is less than a threshold value, the voltage regulator operates in the start-up mode.

18. The voltage regulator according to claim 17, wherein the threshold value is a difference between the input voltage and a turn-on voltage of the second transistor.

19. The voltage regulator according to claim 16, wherein when a voltage on the second terminal of the second transistor is greater than a threshold value, the voltage regulator operates in the normal mode.

20. The voltage regulator according to claim 15, wherein the control circuit further comprises:

a voltage generating circuit comprising a first terminal, a second terminal, and an output terminal, wherein the first terminal of the voltage generating circuit is coupled to the first receiving terminal of the control circuit, the second terminal of the voltage generating circuit is coupled to the second voltage terminal, and the output terminal of the voltage generating circuit is coupled to the input terminal of the detection circuit and is adapted to provide the input voltage.

* * * * *